US006200946B1

(12) United States Patent
Blum et al.

(10) Patent No.: US 6,200,946 B1
(45) **Date of Patent: *Mar. 13, 2001**

(54) TRANSITION METAL AMMINE COMPLEXES AS ACTIVATORS FOR PEROXIDE COMPOUNDS

(75) Inventors: Helmut Blum; Bernd Mayer, both of Duesseldorf; Hans-Juergen Riebe, Solingen; Ulrich Pegelow, Duesseldorf, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/155,850

(22) PCT Filed: Mar. 24, 1997

(86) PCT No.: PCT/EP97/01482

§ 371 Date: Oct. 1, 1998

§ 102(e) Date: Oct. 1, 1998

(87) PCT Pub. No.: WO97/36988

PCT Pub. Date: Oct. 9, 1997

(30) Foreign Application Priority Data

Apr. 1, 1996 (DE) ..... 196 20 411

(51) Int. Cl.[7] ..... C11D 3/395; C11D 7/38; C11D 7/54

(52) U.S. Cl. ..... 510/372; 510/221; 510/224; 510/226; 510/376; 510/378; 252/186.33

(58) Field of Search ..... 510/221, 224, 510/226, 372, 376, 378; 252/186.33

(56) References Cited

U.S. PATENT DOCUMENTS

| | | | | |
|---|---|---|---|---|
| 4,585,642 | | 4/1986 | Rieck | 423/333 |
| 4,664,839 | | 5/1987 | Rieck | 252/175 |
| 4,820,439 | | 4/1989 | Rieck | 252/135 |
| 5,183,651 | | 2/1993 | Schimmel et al. | 423/334 |
| 5,229,095 | | 7/1993 | Schimmel et al. | 423/334 |
| 5,236,682 | | 8/1993 | Schimmel et al. | 423/334 |
| 5,268,156 | | 12/1993 | Schimmel et al. | 423/334 |
| 5,308,596 | | 5/1994 | Kotzian et al. | 423/333 |
| 5,318,733 | | 6/1994 | Carduck et al. | 264/15 |
| 5,356,607 | | 10/1994 | Just | 423/334 |
| 5,358,655 | | 10/1994 | Kruse et al. | 252/95 |
| 5,382,377 | | 1/1995 | Raehse et al. | 252/174 |
| 5,417,951 | | 5/1995 | Just | 423/334 |
| 5,494,488 | | 2/1996 | Arnoldi et al. | 8/137 |
| 5,541,316 | | 7/1996 | Engelskirchen et al. | 510/471 |
| 5,580,941 | | 12/1996 | Krause et al. | 527/300 |
| 5,703,030 | * | 12/1997 | Perkins et al. | 510/311 |
| 5,705,464 | * | 1/1998 | Scheper et al. | 510/221 |
| 5,798,326 | * | 8/1998 | Goldstein et al. | 510/221 |

FOREIGN PATENT DOCUMENTS

| | | |
|---|---|---|
| 94 58592 | 8/1994 | (AU) . |
| 1 036 455 | 8/1978 | (CA) . |
| 24 12 837 | 10/1974 | (DE) . |
| 26 09 221 | 9/1977 | (DE) . |
| 30 02 271 | 7/1981 | (DE) . |
| 42 21 381 | 2/1994 | (DE) . |
| 43 00 772 | 7/1994 | (DE) . |
| 43 03 320 | 8/1994 | (DE) . |
| 44 16 438 | 11/1995 | (DE) . |
| 44 17 734 | 11/1995 | (DE) . |
| 44 43 177 | 6/1996 | (DE) . |
| 0 164 514 | 12/1985 | (EP) . |
| 0 164 552 | 12/1985 | (EP) . |
| 0 272 030 | 6/1988 | (EP) . |
| 0 294 753 | 12/1988 | (EP) . |
| 0 392 592 | 10/1990 | (EP) . |
| 0 425 427 | 5/1991 | (EP) . |
| 0 425 428 | 5/1991 | (EP) . |
| 0 436 835 | 7/1991 | (EP) . |
| 0 443 651 | 8/1991 | (EP) . |
| 0 458 397 | 11/1991 | (EP) . |
| 0 486 592 | 5/1992 | (EP) . |
| 0 502 325 | 9/1992 | (EP) . |
| 0 544 490 | 6/1993 | (EP) . |
| 0 548 599 | 6/1993 | (EP) . |
| 0 549 271 | 6/1993 | (EP) . |
| 0 579 659 | 1/1994 | (EP) . |
| 0 591 282 | 4/1994 | (EP) . |
| 0 630 964 | 12/1994 | (EP) . |
| 4 238 809 | 8/1992 | (JP) . |
| 4 260 610 | 9/1992 | (JP) . |
| WO91/08171 | 6/1991 | (WO) . |
| WO 92/11347 | 7/1992 | (WO) . |
| WO92/11347 | 7/1992 | (WO) . |
| WO93/16110 | 8/1993 | (WO) . |
| WO 94/05762 | 3/1994 | (WO) . |
| WO 94/23005 | 10/1994 | (WO) . |
| WO94/23005 | 10/1994 | (WO) . |
| WO 95/27775 | 10/1995 | (WO) . |
| WO95/33043 | 12/1995 | (WO) . |
| WO 96/06155 | 2/1996 | (WO) . |
| WO 96/23861 | 8/1996 | (WO) . |
| WO96/23859 | 8/1996 | (WO) . |
| WO 97/00312 | 1/1997 | (WO) . |
| WO97/00311 | 1/1997 | (WO) . |

OTHER PUBLICATIONS

Derwent Patent Abstract (WPAT) 77–40004Y/23.
Derwent Patent Abstract (WPAT) 96–011551/02.
Derwent Patent Abstract (WPAT) 96–287166/29.

(List continued on next page.)

*Primary Examiner*—Gregory R. DelCotto
(74) *Attorney, Agent, or Firm*—Wayne C. Jaeschke; Glenn E. J. Murphy

(57) ABSTRACT

A method of oxidizing, washing, cleaning, or disinfecting a soiled article is provided wherein a peroxygen compound is activated by an effective amount of a complex of the formula (I):

$$[M\ (NH_3)_{6-x}(L)_x]A_n \qquad (I)$$

wherein M is iron, copper, or ruthenium, x is a number of 0 to 5, L is a ligand, and A is a salt-forming anion. Also provided are compositions comprising 0.0025% to 0.25% by weight of the complex (I).

19 Claims, No Drawings

OTHER PUBLICATIONS

Derwent Patent Abstract (WPAT) 93–259656/33.
Derwent Patent Abstract (WPAT) 94–035002/04.
Derwent Patent Abstract (WPAT) 94–235530/29.
Derwent Patent Abstract (WPAT) 94–280420/35.
Derwent Patent Abstract (WPAT) 96–000404/01.
Derwent Patent Abstract (WPAT) 74–75753V/44.
Derwent Patent Abstract (WPAT) 91–126877/18.
Derwent Patent Abstract (WPAT) 85–270605/44.
Derwent Patent Abstract (WPAT) 91–172613/24.
Derwent Patent Abstract (WPAT) 92–335303/41.
Derwent Patent Abstract (WPAT) 92–360500/44.
Chemical Abstracts 117:236692n (1991).
Chemical abstracts 118:8928j (1991).
Derwent Patent Abstract (WPAT) 93–206465/26.
Derwent Patent Abstract (WPAT) 92–301673/37.
Derwent Patent Abstract (WPAT) 91–126878/18.
Derwent Patent Abstract (WPAT) 91–209554/29.
Derwent Patent Abstract (WPAT) 85–290431/47.
Derwent Patent Abstract (WPAT) 88–355215/50.
Derwent Patent Abstract (WPAT) 92–218091/27.
Derwent Patent Abstract (WPAT) 94–311135/39.
Derwent Patent Abstract (WPAT) 91–073523/10.
Derwent Patent Abstract (WPAT) 92–350618/43.
Derwent Patent Abstract (WPAT) 93–009585/02.
Derwent Patent Abstract (WPAT) 96–011551/02.
Derwent Patent Abstract (WPAT) 94–075443/10.
Derwent Patent Abstract (WPAT) 96–287166/29.
Derwent Patent Abstract (WPAT) 92–218091/27.

* cited by examiner

TRANSITION METAL AMMINE COMPLEXES AS ACTIVATORS FOR PEROXIDE COMPOUNDS

BACKGROUND OF THE INVENTION

This invention relates to the use of certain oligoammine complexes of transition metals as activators or catalysts for peroxygen compounds, more particularly for bleaching colored stains in the washing of textiles, and to detergents, cleaners and disinfectants containing such bleach activators or bleach catalysts.

Inorganic peroxygen compounds, more particularly hydrogen peroxide, and solid peroxygen compounds which dissolve in water with elimination of hydrogen peroxide, such as sodium perborate and sodium carbonate perhydrate, have long been used as oxidizing agents for disinfecting and bleaching purposes. In dilute solutions, the oxidizing effect of these substances depends to a large extent on the temperature. For example, with $H_2O_2$ or perborate in alkaline bleaching liquors, sufficiently rapid bleaching of soiled textiles is only achieved at temperatures above about 80° C. At lower temperatures, the oxidizing effect of the inorganic peroxygen compounds can be improved by addition of so-called bleach activators for which numerous proposals, above all from the classes of N- or O-acyl compounds, for example polyacylated alkylenediamines, more particularly tetraacetyl ethylenediamine, acylated glycolurils, more particularly tetraacetyl glycoluril, N-acylated hydantoins, hydrazides, triazoles, hydrotriazines, urazoles, diketopiperazines, sulfuryl amides and cyanurates, also carboxylic anhydrides, more particularly phthalic anhydride, carboxylic acid esters, more particularly sodium nonanoyloxybenzenesulfonate, sodium isononanoyloxybenzenesulfonate and acylated sugar derivatives, such as pentaacetyl glucose, can be found in the literature. By adding these substances, the bleaching effect of aqueous peroxide liquors can be increased to such an extent that substantially the same effects are obtained at temperatures of only 60° C. as are obtained with the peroxide liquor alone at 95° C.

In the search for energy-saving washing and bleaching processes, operating temperatures well below 60° C. and, more particularly, below 45° C. down to the temperature of cold water have acquired increasing significance in recent years.

At these low temperatures, there is generally a discernible reduction in the effect of known activator compounds. Accordingly, there has been no shortage of attempts to develop more effective activators for this temperature range although the results achieved thus far have not been convincing. A starting point in this connection is the use of the transition metal salts and complexes proposed, for example, in European patent applications EP 392 592, EP 443 651, EP 458 397, EP 544 490 or EP 549 271 as so-called bleach catalysts. In their case, the high reactivity of the oxidizing intermediates formed from them and the peroxygen compound is presumably responsible for the risk of discoloration of colored textiles and, in extreme cases, oxidative textile damage. In European patent application EP 272 030, cobalt (III) complexes with ammonia ligands which may additionally contain other mono-, bi-, tri- and/or tetradentate ligands are described as activators for $H_2O_2$. European patent application EP 630 964 describes certain manganese complexes which do not have a pronounced effect in boosting the bleaching action of peroxygen compounds and which do not decolor dyed textile fibers although they are capable of bleaching soil or dye detached from fibers in wash liquors. German patent application DE 44 16 438 describes manganese, copper and cobalt complexes which can carry ligands from a number of groups of compounds and which are said to be used as bleaching and oxidation catalysts.

The problem addressed by the present invention was to improve the oxidizing and bleaching effect of inorganic peroxygen compounds at low temperatures below 80° C. and, more particularly, in the range from about 15° C. to 45° C.

It has now been found that certain transition metal complexes containing at least one ammonia molecule as ligand have a distinct effect as bleach catalysts.

DESCRIPTION OF THE INVENTION

The present invention relates to the use of complex compounds corresponding to general formula I:

$$[M(NH_3)_{6-x}(L)_x]A_n \qquad (I)$$

where M is a transition metal selected from cobalt, iron, copper and ruthenium, L is a ligand selected from the group consisting of water, hydroxide, chlorate, perchlorate, $(NO_2)^-$, carbonate, hydrogen carbonate, nitrate, acetate and thiocyanate, x is a number of 0 to 5, A is a salt-forming anion and n—which may even be 0—is a number with such a value that the compound of formula (I) has no charge, as activators for peroxygen compounds, particularly inorganic peroxygen compounds, in oxidizing, washing, cleaning or disinfecting solutions.

In the present case, an $(NO_2)^-$group is a nitro ligand which is attached to the transition metal by the nitrogen atom or a nitrito ligand which is attached to the transition metal by an oxygen atom. The $(NO_2)^-$group may also be attached to a transition metal M to form a chelate

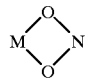

It may also bridge two transition metal atoms asymmetrically:

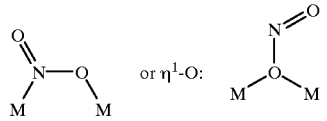

The above-mentioned transition metals in the bleach catalysts to be used in accordance with the invention are preferably present with oxidation numbers of +2, +3 or +4. Complexes with transition metal central atoms having the oxidation number +3 are preferably used. Preferred complexes include those with cobalt as central atom.

Besides the ammonia ligands, the transition metal complexes to be used in accordance with the invention may contain other inorganic ligands of generally simple structure (L in formula I), more particularly mono- or polyvalent anionic ligands, providing at least one ammonia molecule is present as ligand in the complex. Examples of such other ligands are nitrate, acetate, thiocyanate, chlorate and perchlorate. The anionic ligands are intended to provide for charge equalization between the transition metal central atom and the ligand system. Oxo ligands, peroxo ligands and imino ligands may also be present in addition to or instead of the ligands L. These ligands may also have a bridging effect so that polynuclear complexes are formed. These complexes contain at least one ammonia ligand and preferably at least one $(NO_2)^-$ group per transition metal atom. In the case of bridged binuclear complexes, the two metal atoms in the complex do not have to be the same. Binuclear complexes in which the two transition metal central atoms have different oxidation numbers may be used.

In the absence of anionic ligands or if the presence of anionic ligands does not lead to charge equalization in the complex, the compounds to be used in accordance with the invention contain anionic counterions which neutralize the cationic complex. These anionic counterions include in particular nitrate, hydroxide, hexafluorophosphate, sulfate, chlorate, perchlorate, halides, such as chloride, fluoride, iodide and bromide, or the anions of carboxylic acids, such as formate, acetate, benzoate or citrate. These anionic counterions are present in the compounds of formula I in such a number (n in formula I) that—in terms of size—the sum of the product of their number with their charge and the product of the number of anionic ligands (L in formula I) with their charge is exactly as large, but with a negative sign, as the charge of the transition metal central atom (M in formula I).

In cases where L is a bidentate ligand, for example the carbonato ligand, as mentioned above, optionally the $(NO_2)^-$ ligand or the nitrato ligand, which occupies two bond sites of the transition metal central atom in a mononuclear complex compound, formula (I) can only analogously reproduce the structure of the complex. Complex compounds such as these are more clearly represented by general formula (II):

$$[M(NH_3)_{6-x-2y}L_x(L^2)_y]A_n \quad \text{(II)}$$

where M, A, n and x are as defined above, L is a ligand attached via a coordination site and $L^2$ is the ligand attached via two coordination sites and y is a number of 0 to 2, with the proviso that x+2y is at most 5.

Preferred bleach catalysts according to the invention include nitropentammine cobalt(III) chloride, nitritopentammine cobalt(III) chloride, nitratopentammine cobalt(III) chloride, tetrammine carbonato-cobalt(III) chloride, tetrammine carbonato-cobalt(III) hydrogen carbonate and tetrammine carbonato-cobalt(III) nitrate.

A transition metal bleach catalyst such as this is preferably used for bleaching colored stains in the washing of textiles, particularly in a water-based surfactant-containing liquor. The expression "bleaching of colored stains" is meant to be interpreted in its broadest sense and encompasses both the bleaching of soil present on the textiles, the bleaching of soil detached from the textiles and present in the wash liquor and the oxidative destruction of textile dyes present in the wash liquor—which are detached from textiles under the washing conditions—before they can be absorbed by differently colored textiles.

The present invention also relates to detergents, cleaners and disinfectants containing one of the above-mentioned transition metal bleach catalysts and to a process for activating peroxygen compounds using this bleach catalyst.

In the process according to the invention and in the uses according to the invention, the bleach catalyst may be used as an activator anywhere where a particular increase in the oxidizing effect of the peroxygen compounds at low temperatures is required, for example in the bleaching of textiles or hair, in the oxidation of organic or inorganic intermediates and in disinfection.

The use according to the invention essentially comprises creating conditions under which the peroxygen compound and the bleach catalyst can react with one another with a view to obtaining products with a stronger oxidizing effect. Such conditions prevail in particular when both reactants meet in an aqueous solution. This can be achieved by separately adding the peroxygen compound and the bleach catalyst to a solution optionally containing a detergent or cleaner. In one particularly advantageous embodiment, however, the process according to the invention is carried out using a detergent, cleaner or disinfectant according to the invention which contains the bleach catalyst and optionally a peroxidic oxidizing agent. The peroxygen compound may even be separately added to the solution as such or preferably in the form of an aqueous solution or suspension in cases where a peroxygen-free formulation is used.

The conditions can be widely varied according to the application envisaged. Thus, besides purely aqueous solutions, mixtures of water and suitable organic solvents may serve as the reaction medium. The quantities of peroxygen compounds used are generally selected so that the solutions contain between 10 ppm and 10% of available oxygen and preferably between 50 and 5000 ppm of available oxygen. The quantity of bleach-catalyzing transition metal compound used is also determined by the particular application envisaged. Depending on the required degree of activation, the transition metal compound is used in a quantity of 0.00001 mole to 0.025 mole and preferably in a quantity of 0.0001 mole to 0.002 mole per mole of peroxygen compound, although quantities above and below these limits may be used in special cases.

A detergent, cleaner or disinfectant according to the invention preferably contains 0.0025% by weight to 0.25% by weight and, more preferably, 0.01% by weight to 0.1% by weight of the transition metal bleach catalyst corresponding to formula I in addition to typical ingredients compatible with the bleach catalyst. The bleach catalyst may be adsorbed onto supports and/or encapsulated in shell-forming substances by methods known in principle.

In addition to the bleach catalyst used in accordance with the invention, the detergents, cleaners and disinfectants according to the invention, which may be present in the form of—in particular—powder—form solids, in the form of post-compacted particles or in the form of homogeneous solutions or suspensions, may in principle contain any known ingredients typically encountered in such formulations. In particular, the detergents and cleaners according to the invention may contain builders, surfactants, organic and/or inorganic peroxygen compounds, water-miscible organic solvents, enzymes, sequestering agents, electrolytes, pH regulators and other auxiliaries, such as optical brighteners, redeposition inhibitors, dye transfer inhibitors, foam regulators, additional peroxygen activators, dyes and perfumes.

In addition to the ingredients mentioned thus far, a disinfectant according to the invention may contain typical antimicrobial agents to enhance its disinfecting effect on special germs. Antimicrobial additives of the type in question are present in the disinfectants according to the invention in quantities of preferably not more than 10% by weight and, more preferably, in quantities of 0.1% by weight to 5% by weight.

Standard transition metal complexes and/or—particularly in combination with inorganic peroxygen compounds—conventional bleach activators, i.e. compounds which form optionally substituted perbenzoic acid and/or aliphatic peroxocarboxylic acids containing 1 to 10 and more particularly 2 to 4 carbon atoms under perhydrolysis conditions, may be used in addition to the transition metal bleach catalysts corresponding to formula I which contain at least one ammonia molecule as ligand. Suitable conventional bleach activators are the typical bleach activators mentioned at the beginning which contain O- and/or N-acyl groups with the number of carbon atoms mentioned and/or optionally substituted benzoyl groups. Preferred conventional bleach activators are polyacylated alkylenediamines, more particularly tetraacetyl ethylenediamine (TAED), acylated glycolurils, more particularly tetraacetyl glycoluril (TAGU), acylated triazine derivatives, more particularly 1,5-diacetyl-2,4-dioxohexahydro-1,3,5-triazine (DADHT), acylated phenol sulfonates, more particularly nonanoyl or isononanoyloxybenzenesulfonate, acylated polyhydric alcohols, more particularly triacetin, ethylene glycol diacetate and 2,5-diacetoxy-2,5-dihydrofuran, and acetylated sorbitol and mannitol, acylated sugar derivatives, more particularly pentaacetyl glucose (PAG), pentaacetyl fructose, tetaacetyl xylose and octaacetyl lactose and acetylated, optionally N-alkylated glucamine and gluconolactone. The combinations of conventional bleach activators known from German patent application DE 44 43 177 may also be used.

The formulations according to the invention may contain one or more surfactants, more particularly anionic surfactants, nonionic surfactants and mixtures thereof. Suitable nonionic surfactants are, in particular, alkyl glycosides and ethoxylation and/or propoxylation products of alkyl glycosides or linear or branched alcohols containing 12 to 18 carbon atoms in the alkyl group and 3 to 20 and preferably 4 to 10 alkyl ether groups. Corresponding ethoxylation and/or propoxylation products of N-alkylamines, vicinal diols, fatty acid esters and fatty acid amides corresponding to the long-chain alcohol derivatives in regard to the alkyl moiety and of alkylphenols containing 5 to 12 carbon atoms in the alkyl group may also be used.

Suitable anionic surfactants are, in particular, soaps and those which contain sulfate or sulfonate groups preferably having alkali metal ions as cations. Preferred soaps are the alkali metal salts of saturated or unsaturated fatty acids containing 12 to 18 carbon atoms. Fatty acids such as these need not even be completely neutralized for use in accordance with the invention. Suitable surfactants of the sulfate type include salts of sulfuric acid semi-esters of fatty alcohols containing 12 to 18 carbon atoms and sulfation products of the nonionic surfactants mentioned with a low degree of ethoxylation. Suitable surfactants of the sulfonate type include linear alkylbenzenesulfonates containing 9 to 14 carbon atoms in the alkyl moiety, alkanesulfonates containing 12 to 18 carbon atoms and olefin sulfonates containing 12 to 18 carbon atoms, which are formed in the reaction of corresponding monoolefins with sulfur trioxide, and also α-sulfofatty acid esters which are formed in the sulfonation of fatty acid methyl or ethyl esters.

Surfactants such as these are present in the cleaners or detergents according to the invention in quantities of, preferably, 5% by weight to 50% by weight and, more preferably, 8% by weight to 30% by weight while the disinfectants according to the invention and machine dishwashing detergents according to the invention preferably contain 0.1% by weight to 20% by weight and, more preferably, 0.2% by weight to 5% by weight of surfactants.

Particularly suitable peroxygen compounds are organic peracids or peracidic salts of organic acids, such as phthalimidopercaproic acid, perbenzoic acid or salts of diperdodecane diacid, hydrogen peroxide and inorganic salts which give off hydrogen peroxide under the cleaning conditions, such as perborate, percarbonate and/or persilicate. If solid per compounds are to be used, they may be employed in the form of powders or granules which may even be coated in known manner. The peroxygen compounds may be added to the wash or cleaning liquor either as such or in the form of formulations containing them which, in principle, may comprise all the usual ingredients of detergents, cleaners or disinfectants. In one particularly preferred embodiment, alkali metal percarbonate, alkali metal perborate monohydrate or hydrogen peroxide is used in the form of an aqueous solution containing 3% by weight to 10% by weight of hydrogen peroxide. If a detergent or cleaner according to the invention contains peroxygen compounds, the peroxygen compounds are present in quantities of preferably up to 50% by weight and, more preferably, in quantities of 5% by weight to 30% by weight whereas the disinfectants according to the invention preferably contain from 0.5% by weight to 40% by weight and, more preferably, from 5% by weight to 20% by weight of peroxygen compounds.

A formulation according to the invention preferably contains at least one water-soluble and/or water-insoluble, organic and/or inorganic builder. Water-soluble organic builders include polycarboxylic acids, more particularly citric acid and sugar acids, monomeric and polymeric aminopolycarboxylic acids, more particularly methyl glycine diacetic acid, nitrilotriacetic acid and ethylenediamine tetraacetic acid, and polyaspartic acid, polyphosphonic acids, more particularly aminotris-(methylenephosphonic acid), ethylenediamine tetrakis(methylenephosphonic acid) and 1-hydroxyethane-1,1-diphosphonic acid, polymeric hydroxy compounds, such as dextrin, and polymeric (poly)carboxylic acids, more particularly the polycarboxylates obtainable by oxidation of polysaccharides according to International patent application WO 93/16110, polymeric acrylic acids, methacrylic acids, maleic acids and copolymers thereof which may also contain small amounts of polymerizable substances with no carboxylic acid functionality in copolymerized form. The relative molecular weight of the homopolymers of unsaturated carboxylic acids is generally in the range from 5,000 to 200,000 while the relative molecular weight of the copolymers is between 2,000 and 200,000 and preferably between 50,000 and 120,000, based on free acid. A particularly preferred acrylic acid/maleic acid copolymer has a relative molecular weight of 50,000 to 100,000. Suitable, albeit less preferred, compounds of this class are copolymers of acrylic acid or methacrylic acid with vinyl ethers, such as vinyl methyl ethers, vinyl esters, ethylene, propylene and styrene, in which the acid makes up at least 50% by weight of the copolymer. Other suitable water-soluble organic builders are terpolymers which contain two unsaturated acids and/or salts thereof as monomers and vinyl alcohol and/or an esterified vinyl alcohol or a carbohydrate as the third monomer. The first acidic monomer or its salt is derived from a monoethylenically unsaturated $C_{3-8}$ carboxylic acid and preferably from a $C_{3-4}$ monocarboxylic acid, more particularly from (meth)acrylic acid. The second acidic monomer or its salt may be a derivative of a $C_{4-8}$ dicarboxylic acid, maleic acid being particularly preferred, and/or a derivative of an allylsulfonic acid substituted in the 2-position by an alkyl or aryl group. Polymers such as these may be produced in particular by the processes described in German patent DE 42 21 381 and in German patent application DE 43 00 772 and generally have a relative molecular weight in the range from 1,000 to 200,000. Other preferred copolymers are the copolymers which are described in German patent applications DE 43 03 320 and DE 44 17 734 and which preferably contain acrolein and acrylic acid/acrylic acid salts or vinyl acetate as monomers. The organic builders may be used in the form of aqueous solutions, preferably 30 to 50% by weight aqueous solutions, particularly for the production of liquid formulations. All the acids mentioned are generally used in the form of their water-soluble salts, more particularly their alkali metal salts.

If desired, organic builders of the type in question may be present in quantities of up to 40% by weight, more particularly in quantities of up to 25% by weight and preferably in quantities of 1% by weight to 8% by weight. Quantities near the upper limit mentioned are preferably used in paste-form or liquid, more particularly water-containing, formulations according to the invention.

Particularly suitable water-soluble inorganic builders are polyphosphates, preferably sodium triphosphate. Particularly suitable water-insoluble, water-dispersible inorganic builders are crystalline or amorphous alkali metal alumosilicates used in quantities of up to 50% by weight and preferably in quantities of not more than 40% by weight and, in liquid formulations, particularly in quantities of 1% by weight to 5% by weight. Of these inorganic builders, detergent-range crystalline sodium alumosilicates, more particularly zeolite A, P and optionally X, are preferred. Quantities approaching the upper limit mentioned are preferably used in solid particulate formulations. Suitable alumosilicates contain in particular no particles larger than 30 $\mu$m in size, at least 80% by weight preferably consisting of particles below 10 $\mu$m in size. Their calcium binding capacity, which may be determined in accordance with German patent DE 24 12 837, is generally in the range from 100 to 200 mg CaO per gram.

Suitable substitutes or partial substitutes for the alumosilicate mentioned are crystalline alkali metal silicates which may be present either on their own or in the form of a mixture with amorphous silicates. The alkali metal silicates suitable for use as builders in the formulations according to the invention preferably have a molar ratio of alkali metal oxide to $SiO_2$ of less than 0.95:1 and, more particularly, from 1:1.1 to 1:12 and may be present in amorphous or crystalline form. Preferred alkali metal silicates are the sodium silicates, more particularly the amorphous sodium silicates, with a molar $Na_2O:SiO_2$ ratio of 1:2 to 1:2.8. Those with a molar $Na_2O:SiO_2$ ratio of 1:1.9 to 1:2.8 may be produced by the process according to European patent application EP 0 425 427. Preferred crystalline silicates, which may be present either on their own or in the form of a mixture with amorphous silicates, are crystalline layer silicates with the general formula $Na_2Si_xO_{2x+1}yH_2O$, where x—the so-called modulus—is a number of 1.9 to 4 and y is a number of 0 to 20, preferred values for x being 2, 3 or 4. Crystalline layer silicates which correspond to this general formula are described, for example, in European patent application EP 0 164 514. Preferred crystalline layer silicates are those in which x in the general formula mentioned assumes a value of 2 or 3. Both β- and δ-sodium disilicates ($Na_2Si_2O_5yH_2O$) are particularly preferred, β-sodium disilicate being obtainable, for example, by the process described in International patent application WO 91/08171. δ-Sodium silicates with a modulus of 1.9 to 3.2 may be produced in accordance with Japanese patent applications JP 04/238 809 or JP 04/260 610. Substantially water-free crystalline alkali metal silicates corresponding to the above general formula, in which x is a number of 1.9 to 2.1, obtainable from amorphous alkali metal silicates as described in European patent applications EP 0 548 599, EP 0 502 325 and EP 0 425 428, may also be used in the formulations according to the invention. Another preferred embodiment of formulations according to the invention uses a crystalline sodium layer silicate with a modulus of 2 to 3 obtainable from sand and soda by the process according to European patent application EP 0 436 835. Crystalline sodium silicates with a modulus of 1.9 to 3.5 obtainable by the processes according to European patents EP 0 164 552 and/or EP 0 294 753 are used in another preferred embodiment of the formulations according to the invention. If alkali metal alumosilicate, particularly zeolite, is present as an additional builder, the ratio by weight of alumosilicate to silicate, expressed as water-free active substances, is preferably from 1:10 to 10:1. In formulations containing both amorphous and crystalline alkali metal silicates, the ratio by weight of amorphous alkali metal silicate to crystalline alkali metal silicate is preferably 1:2 to 2:1 and, more preferably, 1:1 to 2:1.

Builders are present in the detergents or cleaners according to the invention in quantities of, preferably, up to 60% by weight and, more preferably, from 5% by weight to 40% by weight while the disinfectants according to the invention are preferably free from the builders which only complex the components of water hardness and contain preferably no more than 20% by weight and, more preferably, from 0.1% by weight to 5% by weight of heavy metal complexing agents, preferably from the group consisting of aminopolycarboxylic acids, aminopolyphosphonic acids and hydroxypolyphosphonic acids and water-soluble salts and mixtures thereof.

Enzymes suitable for use in the detergents/cleaners/disinfectants are enzymes from the class of proteases, lipases, cutinases, amylases, pullulanases, hemicellulases, cellulases, oxidases and peroxidases and mixtures thereof. Particularly suitable enzymes are those obtained from fungi or bacteria, such as *Bacillus subtilis, Bacillus licheniformis, Streptomyces griseus, Humicola lanuginosa, Humicola insolens, Pseudomonas pseudoalcaligenes* or *Pseudomonas cepacia*. As described for example in International patent applications WO 92/11347 or WO 94/23005, the enzymes optionally used may be adsorbed onto supports and/or encapsulated in shell-forming substances to protect them against premature inactivation. They are added to the detergents, cleaners and disinfectants according to the invention in quantities of preferably not more than 5% by weight and, more preferably between 0.2% by weight and 2% by weight.

Organic solvents suitable for use in the formulations according to the invention, particularly where they are present in liquid or paste-like form, include alcohols containing 1 to 4 carbon atoms, more particularly methanol, ethanol, isopropanol and tert.butanol, diols containing 2 to 4 carbon atoms, more particularly ethylene glycol and propylene glycol, and mixtures thereof and the ethers derived from compounds belonging to the classes mentioned above. Water-miscible solvents such as these are present in the detergents, cleaners and disinfectants according to the invention in quantities of preferably not more than 30% by weight and, more preferably, in quantities of 6% by weight to 20% by weight.

To establish a desired pH value which is not automatically adjusted by the mixture of the other components, the formulations according to the invention may contain system-compatible and ecologically compatible acids, more particularly citric acid, acetic acid, tartaric acid, malic acid, lactic acid, glycolic acid, succinic acid, glutaric acid and/or adipic acid, and mineral acids, more particularly sulfuric acid, or bases, more particularly ammonium or alkali metal hydroxides. pH regulators such as these are present in the formulations according to the invention in quantities of preferably not more than 20% by weight and, more preferably, between 1.2% by weight and 17% by weight.

The production of the solid formulations according to the invention does not involve any difficulties and may be carried out by methods known in principle, for example by spray drying or granulation, the peroxygen compound and bleach catalyst optionally being added later. To produce formulations according to the invention with high bulk density, more particularly in the range from 650 g/l to 950 g/l, a process comprising an extrusion step known from European patent EP 486 592 is preferably applied. Detergents, cleaners or disinfectants according to the invention in the form of aqueous solutions or solutions containing other typical solvents are produced with particular advantage simply by mixing the ingredients which may be introduced into an automatic mixer either as such or in the form of a solution. In one preferred embodiment of machine dishwashing formulations, the formulations are produced in the form of tablets by the processes disclosed in European patents EP 0 579 659 and EP 0 591 282.

EXAMPLES

A tea-stained cloth of white cotton was washed for 20 minutes at 30° C. in a Launderometer using a bleach-activator-free detergent B1 containing 16% by weight of sodium perborate monohydrate. After rinsing and drying, the reflectance (measurement wavelength 460 nm) of the apparently clean test cloth was photometrically determined. In addition, a detergent B2 containing 6% by weight of TAED and 94% by weight of B1 was tested in the same dosage under the same conditions. The value obtained using a detergent M1 which contained B1, 3% by weight of TAED and the complex nitritopentammine cobalt(III) chloride in a concentration of 50 ppm, based on cobalt, was clearly superior to the values obtained in the comparison tests (Table 1).

TABLE 1

Reflectance values [%]

| Detergent | Reflectance |
|---|---|
| B1 | 58.0 |
| B2 | 63.6 |
| M1 | 65.1 |

It can be seen that a significantly better bleaching effect can be obtained through the use according to the invention (M1) than by the conventional bleach activator TAED in a far higher concentration (B2).

What is claimed is:

1. A method of oxidizing, washing, cleaning, or disinfecting a soiled article wherein a peroxygen compound in an oxidizing, washing, or cleaning solution serving as a reaction medium, said peroxygen compound being in an amount selected to provide said reaction medium with 10 ppm to 10% of available oxygen, is activated by 0.00001 to 0.025 moles per mole of said peroxvgen compound of a complex of the formula (I):

$$[M(NH_3)_{6-x}(L)_x]A_n \quad (I)$$

wherein M is, iron, copper, or ruthenium, L is water, hydroxide, chlorate, perchlorate, $(NO_2)^-$, carbonate, hydrogen carbonate, nitrate, acetate, or thiocyanate, x is a number of 0 to 5, A is a salt-forming anion, and n is a number such that complex (I) is has no charge.

2. A method according to claim 1 comprising bleaching colored stains on a textile article.

3. A method according to claim 1, wherein M has an oxidation number of +2, +3, or +4.

4. A method according to claim 1, wherein A is a halide or an anion of a carboxylic acid.

5. A method according to claim 4, wherein A is chloride.

6. A method according to claim 4, wherein A is formate, acetate, benzoate, or citrate.

7. A method according to claim 1, wherein A is nitrate, hydroxide, hexafluorophosphate, sulfate, chlorate, or perchlorate.

8. A method according to claim 1, wherein the peroxygen compound is activated by a compound that forms a perbenzoic acid, an aliphatic peroxocarboxylic acid, or a derivative thereof under perhydrolysis conditions.

9. A method according to claim 1, wherein the peroxygen compound is an organic per acid, hydrogen peroxide, perborate, percarbonate, or a mixture thereof.

10. An oxidizing, cleaning, washing, or disinfecting composition comprising 0.0025% to 0.25% by weight of a complex of the formula (I):

$$[M(NH_3)_{6-x}(L)_x]A_n \quad (I)$$

wherein M is, iron, copper, or ruthenium, L is water, hydroxide, chlorate, perchlorate, $(NO_2)^-$, carbonate, hydrogen carbonate, nitrate, acetate, or thiocyanate, x is a number of 0 to 5, A is a salt-forming anion, and n is a number such that complex (I) is has no charge and 0.5% to 50% by weight of a peroxygen compound.

11. A composition according to claim 10 comprising 0.01% to 0.1% by weight of the complex (I).

12. A composition according to claim 10 comprising 5% to 50% by weight anionic or nonionic surfactant, up to 60% by weight of a builder, up to 2% by weight of an enzyme, up to 30% by weight of a $C_{1-4}$ alcohol, a $C_{2-4}$ diol, an ether derivative of a $C_{1-4}$ alcohol or a $C_{2-4}$ diol, or mixtures thereof, and up to 20% by weight of a pH regulator.

13. A composition according to claim 12 comprising 8% to 30% by weight anionic or nonionic surfactant, 5% to 40% by weight of a builder, 0.2% to 0.7% by weight of an enzyme, 6% to 20% by weight of a $C_{1-4}$ alcohol, a $C_{2-4}$ diol, an ether derivative of a $C_{1-4}$, alcohol or a $C_{2-4}$ diol, or mixtures thereof, and 1.2% to 17% by weight of a pH regulator.

14. A composition according to claim 10 wherein the peroxygen compound is selected form the group consisting of hydrogen peroxide, perborate, percarbonate, and mixtures thereof.

15. A composition according to claim 14 comprising 5% to 30% by weight of the peroxygen compound.

16. The composition of claim 10 comprising 0.5% to 40% by weight of the peroxygen compound.

17. The composition of claim 10 comprising 0.5% to 40% by weight of the peroxygen compound.

18. The composition of claim 10 comprising 5% to 30% by weight of the peroxygen compound.

19. The composition of claim 10 comprising 5% to 20% by weight of the peroxygen compound.

* * * * *